United States Patent [19]

Wiedermann

[11] 4,149,447

[45] Apr. 17, 1979

[54] MULTI-EFFECT PASSIVE DETONATION TRAP

[75] Inventor: Arne H. Wiedermann, Chicago Heights, Ill.

[73] Assignee: The United States of America as represented by the Secretary of the Army, Washington, D.C.

[21] Appl. No.: 792,152

[22] Filed: Apr. 29, 1977

[51] Int. Cl.[2] ..... F42B 33/00

[52] U.S. Cl. ..... 86/1 B; 181/269

[58] Field of Search ..... 86/1 B, 20 C; 166/63, 166/299; 181/249, 269; 102/1

[56] References Cited

U.S. PATENT DOCUMENTS 3,610,089 10/1971 Cook et al. ..... 86/20 C

FOREIGN PATENT DOCUMENTS 232987 6/1944 Switzerland ..... 181/269

*Primary Examiner*—Harold J. Tudor

*Attorney, Agent, or Firm*—Nathan Edelberg; A. Victor Erkkila; Max Yarmovsky

[57] ABSTRACT

A multi-effect passive detonation trap utilizes a manifold having a rectangularly shaped cross sectional area with oppositely disposed off-set pipeline fixedly connected thereto to attenuate an upstream detonation wave. The detonation wave is arrested by providing for maximum containment and self relief of the energy produced, directional control of the reaction, and a manifold configuration which assures extinction of the detonation wave.

7 Claims, 3 Drawing Figures

MULTI-EFFECT PASSIVE DETONATION TRAP

GOVERNMENTAL INTEREST

The invention described herein was made in the course of a contract with the Government and may be manufactured, used and licensed by or for the Government for governmental purposes without the payment to me of any royalty thereon.

BACKGROUND OF THE INVENTION

The development of continuous production of high explosive materials, such as TNT, which are frequently transported in in process and in molten form in steam jacketed pipelines or ducts from one process location to another or from one building to another, has imposed the need for devices to minimize the chance of cumulative propagation of an accidental detonation event by attenuation of the detonation wave. Various means have been used in the prior art to interrupt a column of explosive material in order to reduce the supply of detonable material involved. Some prior art detonation trap devices accomplished this objective by insertion of a barrier or plug into an explosive carrying transmission line. Other prior art detonation trap devices reduce the supply of detonable material by separating the supply pipeline or column ends from each other by the creation of an air gap therebetween. Some prior art devices quench the detonation wave by the injection of a foreign material, such as water, which acts as an energy absorber and thus changes the state of the explosive fluid line. All of the abovementioned types of detonation traps require a minimum pipeline length to insure that the reignition of the downstream column does not take place. The problem with the aforementioned "active" detonation trap systems that effect the attenuation by the insertion of a barrier, the creation of an air gap, or by the introduction of a foreign material, is that the attenuation can only be accomplished by the rapid movement of hardware. In the aforementioned devices the existence of the detonation wave must first be detected and then the trap device activated. Usually such "active" detonation trap systems must utilize a control means to interpret a sensor signal, which then functions to generate a firing signal. The closure means and the signal processing means will require some finite time, therefore, the sensing means must generally be located some distance from the closure or barrier means in order to allow sufficient response time. The change of state type of detonation trap also has a similar time problem because material to be introduced into the explosive carrying line must be moved rapidly from a storage line to the transmission line in order to stop the cumulative self supporting reaction.

In contradistinction with the aforementioned prior detonation trap devices the present invention utilizes a critical size or confinement type detonation trap which does not involve any moving parts and therefore may be categorized as a "passive" type. The present invention tends not to propagate the chemical reaction causing the detonation wave because it reduces the ability of the system to concentrate enough energy at the point where the reaction is occurring and prevents the continuation and/or growth of the initial detonation wave. In a critical size detonation trap device, the rapid expansion of the reaction products, comprising essentially gaseous products, transports sufficient amount of energy away from the reaction zone to cause the reaction rate to decay whenever the size of the system is below a certain critical value. The response or flow of the explosive reaction products in transport lines generally depend upon the degree of confinement and the geometry of the transmission system, I have found that the critical size effect reflects the influence that confinement and geometry plays in propagation or decay. FIG. 1 is a plot illustrating how the critical size may vary as a function of a given confinement geometry. From FIG. 1 we see that the critical size can vary between the limits $D_u$, which represents the unconfined case where the confinement is basically controlled by the inertia of the material itself, and the value $D_e$, which represents the heavily confined case. Devices falling into the latter case would approach that of a constant volume system.

Other phenomena associated with the loss of energy from the reaction zone include such effects as the nonsteady expansion resulting from a sudden enlargement of the explosive system which interacts with the confinement system in a complex way. An example of the local loss of energy from the reaction zone is the type of interaction which results in the phenomenon of low velocity detonation. In this latter type of reaction the initial state of the materials is momentarily altered. A similar effect occurs when there is prepressurization or dead pressing of the material such that it will not support the undesirable chemical reaction.

SUMMARY OF THE INVENTION

The present invention relates to a multi-effect passive detonation trap used in a pipeline for transporting explosive material such as molten TNT. The present device includes the multi-effect features of energy self-relief, direction control of the detonation wave, and suitable reduced critical size of a flat manifold opening connecting off-set oppositely disposed upstream and downstream pipelines each having normal explosive material diameters.

An object of the present invention is to provide a multi-effect passive detonation trap for a pipeline carrying molten TNT.

Another object of the present invention is to provide a multi-effect passive detonation trap which insures attenuation of a detonation wave therein by being of proper critical size to allow rapid expansion of the reaction products, thus permitting sufficient amount of energy to be transported away from the explosion reaction zone.

Another object of the present invention is to provide a multi-effect passive detonation trap which will insure attenuation of a detonation wave in a pipeline carrying molten TNT without the use of any moving parts.

Another object of the present invention is to provide a multi-effect passive detonation trap for pipeline carrying molten TNT explosives by utilizing directional control of the explosive reaction.

A further object of the present invention is to provide a multi-effect passive detonation trap which assures extinction of the detonation by the use of a relatively narrow flat manifold having off-set oppositely disposed upstream tubular inlet port and downstream tubular outlet ports of normal pipeline explosive carrying diameters.

For a better understanding of the present invention, together with other and further objects thereof, reference is made to the following descriptions taken in connection with the accompanying drawings.

BRIEF-DESCRIPTION OF THE DRAWINGS

Throughout the following description like reference numerals are used to denote like parts of the drawings.

DESCRIPTION OF THE PREFERRED EMBODIMENTS

Figure 2:
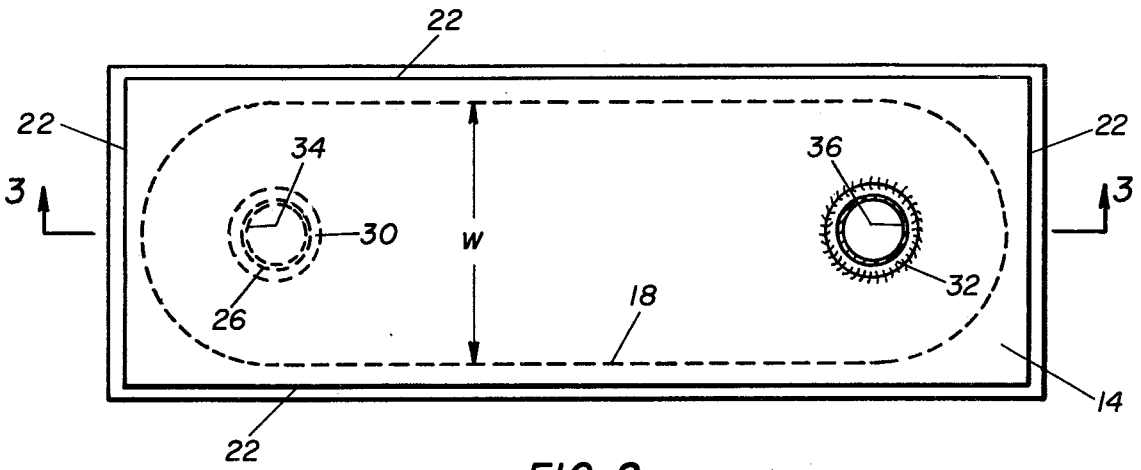
FIG. 2 is a plan view of a multi-effect passive detonation trap.
Figure 3:
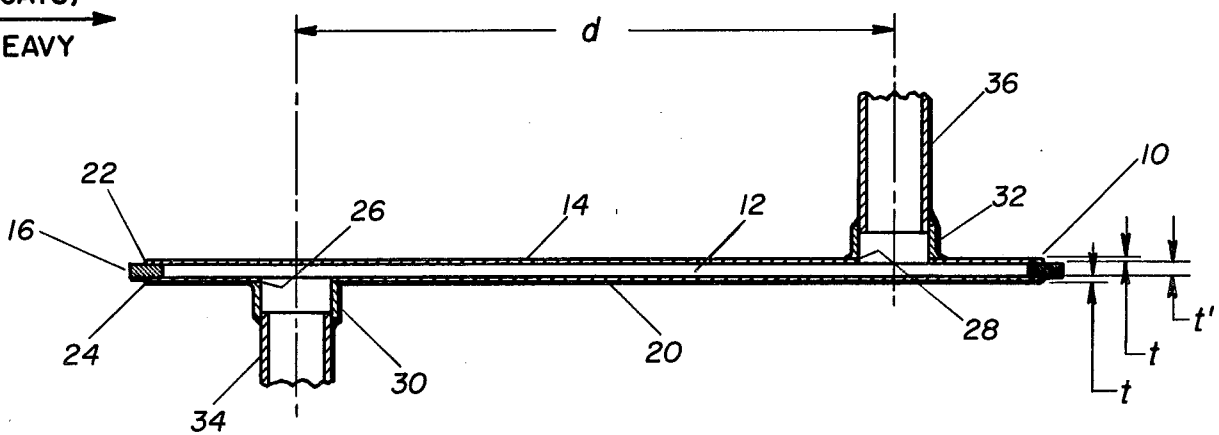
FIG. 3 is a cross-sectional view of the multi-effect passive detonation trap taken along line 3—3 of FIG. 2.
Figure 1:
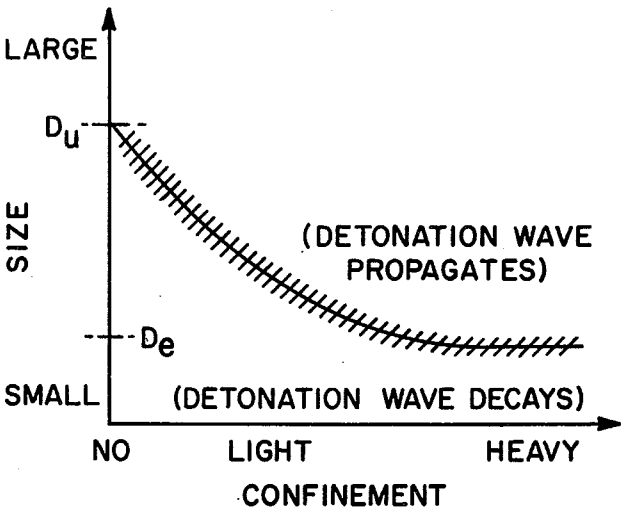
FIG. 1 is a plot of pipeline transport size versus confinement condition of the explosive reaction indicating areas above and below a critical size exponentially shaped curve which indicates where the detonation wave propagates or decays respectively.

Referring now to FIGS. 2 and 3 a sandwiched plate assembly 10 forms a thin manifold duct 12 fabricated from a top manifold plate 14, an intermediate separating plate 16 having an elongated transversely positioned flow cavity 18 therein provides for passage of explosive material therethrough, and a rectangularly shaped bottom manifold plate 20. The three plates are fabricated from mild steel material. Plate 16 is welded near its outer edge to plates 14 and 20 at their peripheral top and bottom edges 22 and 24 respectively. The top and bottom manifold plates are of a thickness (t) approximately 1/16 inches, and the intermediate manifold plate is of thickness (t'), approximately 3/16 inches thick. An upstream inlet manifold port hole 26 is proximately disposed near one end of the bottom manifold plate 20 and another one inch downstream manifold outlet port hole 28 is operatively disposed near one end of the top manifold plate 14. The centerline of the two port holes 26 and 28 are offset by a distance (d) to provide directional control of the oncoming detonation wave. A first internally threaded pipe coupling 30 and a second internally threaded pipe coupling 32 are axially aligned with and welded to the circumferential edges of inlet and outlet port 26 and 28 respectively. A one inch diameter tubular steel inlet pipe 34 and outlet pipe 36 are threadedly fitted to couplings 30 and 32 respectively. The offset distance (d) as shown in FIG. 3 between the pipelines 34 and 36 may vary from 12 to 18 inches. The thin manifold duct cross sectional dimensions are determined by width W of approximately 4.25 inches and by a thickness t' of 3/16 of an inch giving a manifold rectangular cross sectional area wxt' of approximately 0.796 inches square.

In operation, a detonation initiated upstream in pipeline 34 will start a detonation wave whose amplitude will decrease to the point that the detonation wave will be completely arrested at approximately 7–8 inches from the perpendicular upstream pipe section 34 leaving the downstream pipeline 36 and the manifold intact. The detonation wave is successfully arrested within the manifold section because of (1) minimum containment and self-relief of the energy produced by the detonation, (2) directional control of the explosive reaction with the introduction of the off-set pipeline arrangement between the inlet pipe 34 and the outlet pipe 36, and (3) the critical size selection of the manifold passageway 12 which assures diminuation and extinguishment of the detonation wave.

While there has been described and illustrated specific embodiments of the invention, it will be obvious that various changes, modifications and additions can be made herein without departing from the field of the invention which should be limited only by the scope of the appended claims.

Having thus fully described the invention, what is claimed as new and desired to be secured by Letters Patent of the United States is:

1. A multi-effect passive detonation trap for attenuating an upstream detonation wave in a pipeline carrying a molten explosive material which comprises:

rectangularly shaped manifold means for providing for maximum containment and self relief of the energy produced by said upstream detonation wave and extinction thereof which includes;

a rectangularly shaped solid top manifold plate having an outlet port hole therein disposed near one end thereof;

a first internally threaded pipe coupling fixedly welded to one side of said top manifold plate in axial alignment with said outlet port hole;

a rectangularly shaped solid bottom manifold plate having an inlet port hole therein disposed near one end thereof;

a second internally threaded pipe coupling fixedly welded to one side of said bottom manifold plate in axial alignment with said inlet port hole;

a solid separating plate having an elongated flow cavity therein, said separating plate being welded intermediate said top and bottom manifold to form a thin manifold duct of rectangular cross section therethrough and to position said first and second pipe couplings so that they are on opposite sides of said separating plate and off-set with respect to the centerlines of each other by an off-set distance d;

upstream inlet pipeline means fixedly coupled to a bottom side of said manifold means; and downstream outlet pipeline means fixedly coupled to a top side of said manifold means, said outlet pipeline means being substantially off-set from said inlet pipeline means for providing directional control of the explosive reaction of said upstream detonation wave.

2. A multi-effect passive detonator trap as recited in claim 1 wherein said inlet pipeline means is a tubular pipe made of such material as steel.

3. A multi-effect passive detonator trap as recited in claim 1 wherein said outlet pipeline means is a tubular pipe made of such material as steel.

4. A multi-effect passive detonator trap as recited in claim 1 wherein said top and bottom manifold plate is made of mild steel material having a thickness t.

5. A multi-effect passive detonator trap as recited in claim 1 wherein said separating plate is made of mild steel material having a thickness t'.

6. A multi-effect passive detonator trap as recited in claim 1 wherein said manifold duct has a rectangular cross-sectional area, $t' \times W$, of approximately 0.796 inches square; wherein t' is equal to the thickness of said cross-sectional area and W is equal to the dimensional width of said cross-sectional area.

7. A multi-effect passive detonator trap as recited in claim 1 wherein said off-set distance d may vary from 12 to 18 inches.

* * * * *